US009108377B2

(12) United States Patent
Frangenberg

(10) Patent No.: US 9,108,377 B2
(45) Date of Patent: Aug. 18, 2015

(54) ROLLER PRESS HAVING TORQUE BALANCE

(75) Inventor: Meinhard Frangenberg, Kuerten (DE)

(73) Assignee: KHD Humboldt Wedag GmbH, Cologne (DE)

( * ) Notice: Subject to any disclaimer, the term of this patent is extended or adjusted under 35 U.S.C. 154(b) by 311 days.

(21) Appl. No.: 13/703,684

(22) PCT Filed: May 6, 2011

(86) PCT No.: PCT/EP2011/057305

§ 371 (c)(1), (2), (4) Date: Dec. 12, 2012

(87) PCT Pub. No.: WO2011/157483

PCT Pub. Date: Dec. 22, 2011

(65) Prior Publication Data

US 2013/0087054 A1 Apr. 11, 2013

(30) Foreign Application Priority Data

Jun. 18, 2010 (DE) ..... 10 2010 024 231

(51) Int. Cl.

| | |
|---|---|
| ***B02C 4/32*** | (2006.01) |
| ***B30B 15/04*** | (2006.01) |
| ***B30B 3/04*** | (2006.01) |
| ***B30B 15/00*** | (2006.01) |

(52) U.S. Cl.

CPC ... *B30B 3/04* (2013.01); *B02C 4/32* (2013.01); *B30B 15/00* (2013.01); *B30B 15/04* (2013.01)

(58) Field of Classification Search

CPC ..... B30B 15/00; B30B 15/04; B30B 3/04; B02C 4/32

USPC ..... 100/35, 47, 50, 163 R, 164, 168, 169, 100/170, 176

See application file for complete search history.

(56) References Cited

U.S. PATENT DOCUMENTS

| | | | | |
|---|---|---|---|---|
| 3,200,441 | A * | 8/1965 | Geier | 425/79 |
| 3,203,267 | A * | 8/1965 | De Brie Perry | 476/42 |
| 4,212,504 | A * | 7/1980 | Krylov et al. | 384/120 |
| 4,481,799 | A * | 11/1984 | Glattfelder et al. | 72/10.5 |
| 2001/0023215 | A1 * | 9/2001 | Misada | 476/10 |
| 2002/0023473 | A1 * | 2/2002 | Harako et al. | 72/245 |
| 2007/0283823 | A1 * | 12/2007 | Zeigler et al. | 100/47 |

FOREIGN PATENT DOCUMENTS

| | | |
|---|---|---|
| DE | 4234481 | 4/1994 |
| DE | 102007059072 | 6/2009 |

* cited by examiner

*Primary Examiner* — Jimmy T Nguyen
(74) *Attorney, Agent, or Firm* — Greer, Burns & Crain Ltd.

(57) ABSTRACT

A roller press for the pressure treatment or compaction of granular material, having at least two rolls formed as freely rotating rolls, in each case rotatably mounted in a machine frame by a shaft, driven in opposite directions and separated from one another by a roll gap. The shafts of the rolls are accommodated in bearing housings movably mounted in the machine frame and in each case two bearing housings arranged on one side of the rolls and belonging to different rolls are connected to each other via at least one pressure cylinder. The connection between the bearing housings in each case has at least one torque balance. In this way, the structure of a roller press having roller centering is simplified and can be produced more cost-effectively.

9 Claims, 2 Drawing Sheets

ROLLER PRESS HAVING TORQUE BALANCE

BACKGROUND OF THE INVENTION

The invention relates to a roller press for the pressure treatment or compaction of granular material, having at least two rolls, configured as freely rotating rolls, which are respectively rotatably mounted in a machine frame via a shaft, are driven in counter rotation and are separated from one another by a roll gap, wherein the shafts of the rolls are accommodated in bearing housings movably disposed in the machine frame, and wherein in each case two bearing housings disposed on one side of the rolls and belonging to different rolls are connected to each other via at least one pressure cylinder.

For the centering of the roll gap in roller presses for the pressure treatment or compaction of granular material, the rolls of the roller press are generally held by large-sized hydraulic drives in their desired position in order that, on the one hand, the pressure in the roll gap between the rolls is maintained and, on the other hand, as a result of the centering, the parallelism of the boundary of the roll gap is maintained by the surface of the rolls. In this centering operation, the hydraulic drives operate with high force, both to maintain the parallelism of the roll gap and to maintain the pressure in the roll gap. To this end, in the simplest case a first roll is mounted as a fixed roll immovably in the machine frame in bearings, which for their part are fastened to brackets by bearing housings in a machine frame. In contrast, a second roll is mounted as a movable roll in bearings which are disposed in bearing housings arranged movably between two brackets of the machine frame. The hydraulic drives, for the relative positioning of the movable roll in relation to the fixed roll and for the maintenance of the pressure in the roll gap, apply high forces to the machine frame as a counter bearing, so that it is necessary to design the machine frame in appropriately stable construction.

In roller presses having rolls with a weight of up to 50 metric tons, an appropriately large dimensioning of the machine frame is necessary, so that, in a necessary and scheduled roll change, the logistics and handling of the machine frame are complex and possible only with appropriately large-sized cranes and disassembly aids.

In order to reduce the scale of the necessary dimensioning of the machine frame, it is proposed in DE 102005006090 A1 to configure both rolls of the roller press as a movable roll, wherein these two movable rolls are connected to each other via the bearings and the bearing housings and via hydraulic drives. The rolls, the bearings, the bearing housings and the hydraulic drives here form a closed system of forces which relieves the machine frame of load and which machine frame can thus be dimensioned smaller. This arrangement has proved itself in practice. Since in this roller press the closed system of forces is configured displaceably in relation to the machine frame, it is necessary to center the closed system of forces during operation in order that the roll gap does not drift during operation of the press. This centering is achieved by the use of an appropriately dimensioned hydraulic system. It is here necessary to control by control circuits the hydraulics, which, counter to the forces of the moving system of rolls, hydraulics and bearings, such as bearing housings, center the roll gap.

In a refinement of this roller press, in DE 102007059072 it is proposed to use a hydraulic double cylinder which is fastened to the machine frame. In this hydraulic double cylinder, two adjacent hydraulic chambers operate and are supported one against the other. Despite the forces which operate on the hydraulic system, that force of the hydraulic cylinder which acts upon the roll gap is not transmitted to the machine frame. For the centering of the roll gap, it is necessary however to provide by a multi-quadrant operation the hydraulic pressures necessary to generate the pressure in the roll gap.

SUMMARY OF THE INVENTION

The object of the invention is therefore to refine the roller presses such that the centering is designed such that it can be produced more easily and more cost-effectively, while maintaining the system of forces which is self-contained and is largely separate from the machine frame.

The object of the invention is achieved by virtue of the fact that the connection between the bearing housings respectively has at least one torque balance. Further advantageous embodiments of the invention are described herein. The method-related object of the invention is achieved by the use of the torque balance between the bearing housings.

By a torque balance is understood a rocker-like or pendulum-like suspension mounting, which is acted upon by first and second hydraulic cylinders, which work one against the other in pairs, on opposite-situated arms of the torque balance. These mutually counteracting hydraulic cylinders in each case individually produce the tilting of the torque balance in the direction of the related hydraulic cylinder. This change in position of the torque balance has on the side lying opposite the related first hydraulic cylinder the effect that the opposite-situated second hydraulic cylinder is more strongly loaded and therefore the control circuit of the now more strongly loaded second hydraulic cylinder builds up a higher pressure and acts counter to the first hydraulic cylinder until the torque balance is positioned back in its equilibrium setting. In the inventive roller press, the first and the second hydraulic cylinder have a clutch which is designed to be rotationally movable, so that the first and the second hydraulic cylinder can also act at an angle upon the arms of the torque balance. As a result of this rotationally movable clutch, it is possible that the rolls of the roller press can also assume settings which are not parallel to one another, which is always the case whenever a larger grain outside the middle of the roll gap passes through the roll gap or whenever the roll gap is unevenly charged with grinding stock. The effect of the torque balance is that, via a simple, movably mounted, mechanical element, a roll centering is enforced, insofar as the hydraulic cylinders working to generate the pressure in the roll gap counteract each other. As a result of the torque balance, it is also possible, where necessary, to equalize the force of two non-balanced and mutually counteracting hydraulic cylinders. Hydraulic regulating systems for operating the various cylinders in multi-quadrant operation are not necessary in this case, because the equalization happens automatically.

The torque balance can be of non-symmetrical or symmetrical construction. In the case of nonsymmetrical construction, the symmetry of the torque balance, specifically the unequal length of the arms of the torque balance, reflects the different size and nominal load capacity of the mutually opposing hydraulic cylinders. However, a symmetrical embodiment of the torque balance, which is disposed roughly midway between the bearing housings, is referred. The equal length arms of the torque balance are in this case acted upon by two identical hydraulic cylinders or, at least, two hydraulic cylinders having the same nominal load capacity and the same characteristic curve.

The torque balance is mounted in a preferred manner rotatably about a vertical rotation shaft which lies in a plane spanned by the centerline of the roll gap and the vertical. As a result of the vertical rotation axis, the torque balance rotates in a horizontal plane and thus allows a misalignment of the rolls relative to one another, wherein the torque balance has a compensating effect, so that the rolls, in the event of misalignment, are subjected to a force which, following the return of the roller press into the equilibrium setting, causes the rolls of the roller press to stand parallel to one another again.

In a preferred embodiment of the invention, the torque balance has a rocker having two arms, via which the two bearing housings of the roller press are connected to each other, and the torque balance has a rotatably mounted pendulum, via which the two-armed rocker is mounted pivotably about the rotation shaft. As a result of the pendulum, the two-armed rocker of the torque balance rotates about a center of rotation outside the force line between the two hydraulic cylinders, which pull on the opposite-situated arms of the torque balance. The effect of this is that only a small part of the force of the hydraulic cylinders is transmitted to the rotation shaft, since the torque balance, if the force of two mutually counteracting hydraulic cylinders is uneven, tilts toward the one or other side, so that the force of the hydraulic cylinders, which have a changed direction as a result of the misalignment, is always transmitted in a straight line one to another and not to the machine frame.

Although the system of forces consisting of rolls, shafts, bearings, bearing housings, hydraulic cylinders and torque balance is closed and therefore does not transmit the force for generating the pressure in the roll gap to the machine frame, or only transmits said force to the machine frame to the extent of a small directional component, the rotation shaft is nevertheless fixedly connected to the machine frame. Even though the torque balance is supported on the rotation shaft, the high forces of the hydraulic cylinders, which act upon the torque balance respectively in pairs and in mutually opposing arrangement, are diverted by the torque balance, so that the force, or at least the greatest share thereof, acts always in the direction of the hydraulic cylinders.

In the inventive roller press, the hydraulic cylinders are subjected only to tensile load. The torque balance hence has the effect that the distance apart of the hydraulic cylinders is minimized and the torque balance thereby aligns itself. This produces the centering effect on the roll gap.

In a preferred embodiment of the invention, two bearings of two different rolls on one side of the roller press are configured as fixed bearings, and two bearings on the opposite side of the roller press are configured as loose bearings. The loose bearings enable an axial movement of the shaft in the bearing, so that the temperature-induced change in the length of the roll is compensated and also the distance apart of the bearings when the rolls are tilted. Irrespective of the degrees of freedom provided by the loose bearings, the bearing housings of all bearings are mounted on a slide rail in the machine frame. Thus the bearings can travel in a direction perpendicular to the centerline of the roll gap and the loose bearings provide a degree of freedom in the axial direction, i. e. parallel to the centerline of the roll gap.

BRIEF DESCRIPTION OF THE DRAWINGS

The invention is explained in greater detail with reference to the following figures, wherein.

DETAILED DESCRIPTION OF THE PREFERRED EMBODIMENTS

Figure 1:
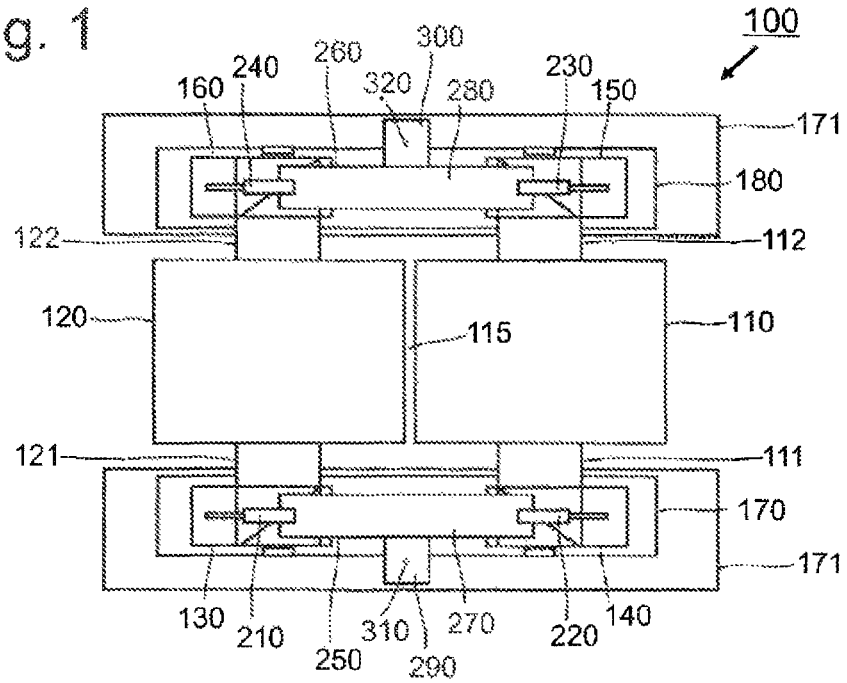
FIG. 1 shows a diagrammatized view of an inventive roller press in the state of equilibrium from above, with partially blanked-out machine frame parts.

In FIG. 1, an inventive roller press 100 is depicted in a view from above (parts of a machine frame are blanked out for better representation of the individual parts). In this roller press 100, a first roll 110 is rotatably mounted in the roller press 100 with the aid of shafts -111 and 112. A second, adjacent roll 120, which for its part is rotatably mounted via shafts 121 and 122 in the roller press, is disposed in the roller press 100, with the formation of a roll gap 115 to be centered. During operation of the roller press 100, the two rolls 110 and 120 are driven in counter rotation, so that the grinding stock delivered from above to the roll gap 115 is drawn into the roll gap 115.

The mounting of the rolls 110 and 120 in the roller press 100 is realized via fixed bearings disposed in the fixed bearing housings 130 and 140 and via loose bearings disposed in the loose bearing housings 150 and 160, which in the roller press 100 lie opposite the fixed bearing housings 130 and 140 in the axial direction of the rolls 110 and 120. These bearing housings 130, 140, 150 and 160 are, for their part, disposed on slide rails 170 and 180, on which the bearing housings 130, 140, 150 and 160, together with the therein accommodated bearings and the, in turn, therein accommodated shafts 111, 112, 121 and 122, can perform in the machine frame 171, which is here represented only fragmentally and in part, horizontal compensating motions perpendicular to the axis of the rolls 110 and 120. The bearing housings 130, 140, 150 and 160 can also in small measure execute rotary motions about a vertical axis of the bearing housings 130, 140, 150 and 160.

Fixed bearing housings 130 and 140 and loose bearing housings 150 and 160 respectively form on an axial side of the rolls 110 and 120, together with the respectively upper torque balance 250 or torque balance 260 (visible in this view), the lower torque balances 250' and 260' (non-visible in this view), and the respectively associated, tensile loaded, top-situated hydraulic cylinders 210, 220, 230 and 240, as well as non-visible, bottom-situated hydraulic cylinders 210', 220', 230' and 240', a closed system of forces. In this system of forces, the respectively upper torque balances 250 and 260, as well as the lower torque balances 250', 260' (non-visible in this view), are fastened in a rotationally movable manner to the machine frame 171 via pivots 310 and 320.

During the operation of the roller press 100, it happens that the rolls 110 and/or 120 must perform compensating motions for the passage of, where necessary, non-reducible particles, such as, for instance, pieces of metal which have inadvertently made their way into the grinding stock, or for the passage of grinding stock which is unevenly distributed over the length of the roll gap 115. During this compensating motion, the roller press is temporarily in a state of disequilibrium. This state is represented in the following figure, FIG. 2.

Figure 2:
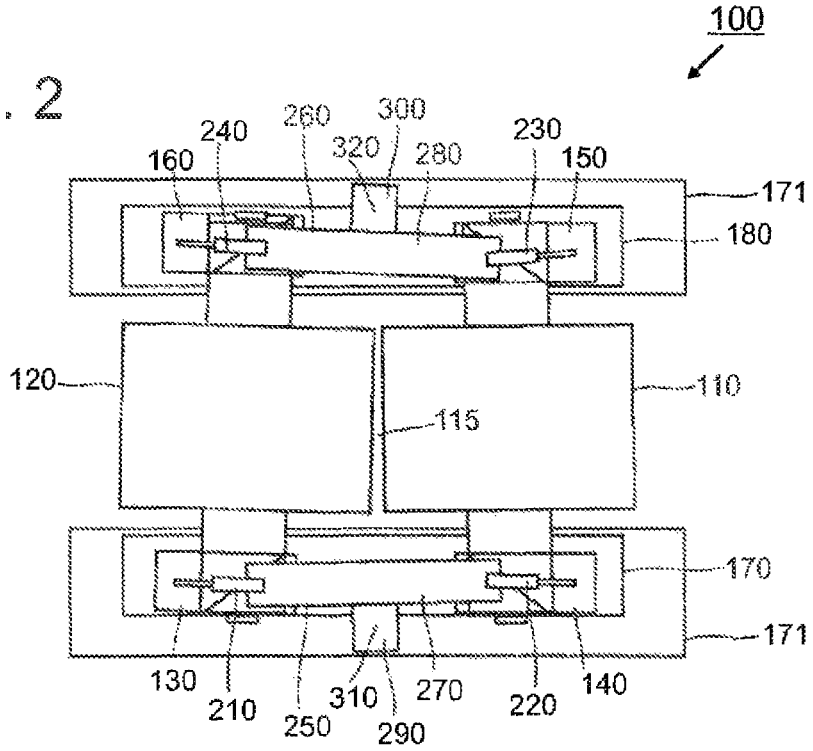
FIG. 2 shows the same arrangement as in FIG. 2, but in the deflected state.

FIG. 2 shows the roller press 100 during a moment of a compensating motion, which motion is shown in exaggerated representation. Both the roll 110 and the roll 120 have a slight rotary motion about a vertical axis, whereby the roll gap, 115 has a trapezoidal profile, having an opening of the roll gap 115 which in FIG. 2 is larger on the bottom side. This compensating motion is only possible if the bearing housings 130, 140, 150 and 160 on the slide rail 170 and 180 can deviate in the horizontal direction and if the loose bearings in the loose bearing housings 150 and 160 permit an axial motion of the shafts 112 and 122.

As a result of the tilt of the rolls 110 and 120, the bearings, together with the bearing housings 130, 140, 150 and 160, are also moved forcibly out of their position of equilibrium. Since the bearing housings 130 and 140, and 150 and 160, are connected in pairs via the torque balances 250 and 260, and since the torque balances 250 and 260, by pivots 310 and 320, are mounted via the pendulums 290 and 300 rotatably about a vertical axis in the machine frame 171, the force is transmitted by the compensating motion of a roll 110, 120 to the respectively other roll 120, 110. The, in FIG. 2, upper torque balance 260 is skewed in the clockwise direction, while in that state of the roller press 100 which is represented here the lower torque balance 250 is skewed slightly in the counter-clockwise direction. In this state of the roller press 100, the distance apart of the bearing housings 130 and 140 and/or bearing housings 150 and 160, which are grouped in pairs, is greater than in the state of equilibrium depicted in FIG. 1. As a result of the tensile force of the two hydraulic cylinders 210 and 220 and/or of the hydraulic cylinders 230 and 240, the roller press 100 is inclined to revert to the state of equilibrium represented in FIG. 1, whereupon the trapezoidal roll gap represented in FIG. 2 reassumes a rectangular profile and is aligned centered in the machine frame 171. For the centering of the roll gap 115, the pivots 310 and 320 do not have to absorb the forces of the tensile loaded hydraulic cylinders 210, 220, 230 and 240, yet the rotationally movable suspension mounting of the torque balance 250 and/or 260 means that an aligned equilibrium setting of the rolls 110 and 120 is possible only in a horizontal position, whereby the roll gap 115 is centered.

One advantage in the use of the torque balance is a simplification of the hydraulic control, which in extremis can take place on an individual basis without mutual compensation, because the torque balance is capable of compensating slight deviations in the control characteristic of the hydraulic systems one to another. In addition, the use of multi-chamber hydraulic cylinders is able to be dispensed with. The here presented roller press 100 is robust, offers automatic centering and, as a result of the closed system of forces, can be equipped with a light machine frame.

Figure 3:
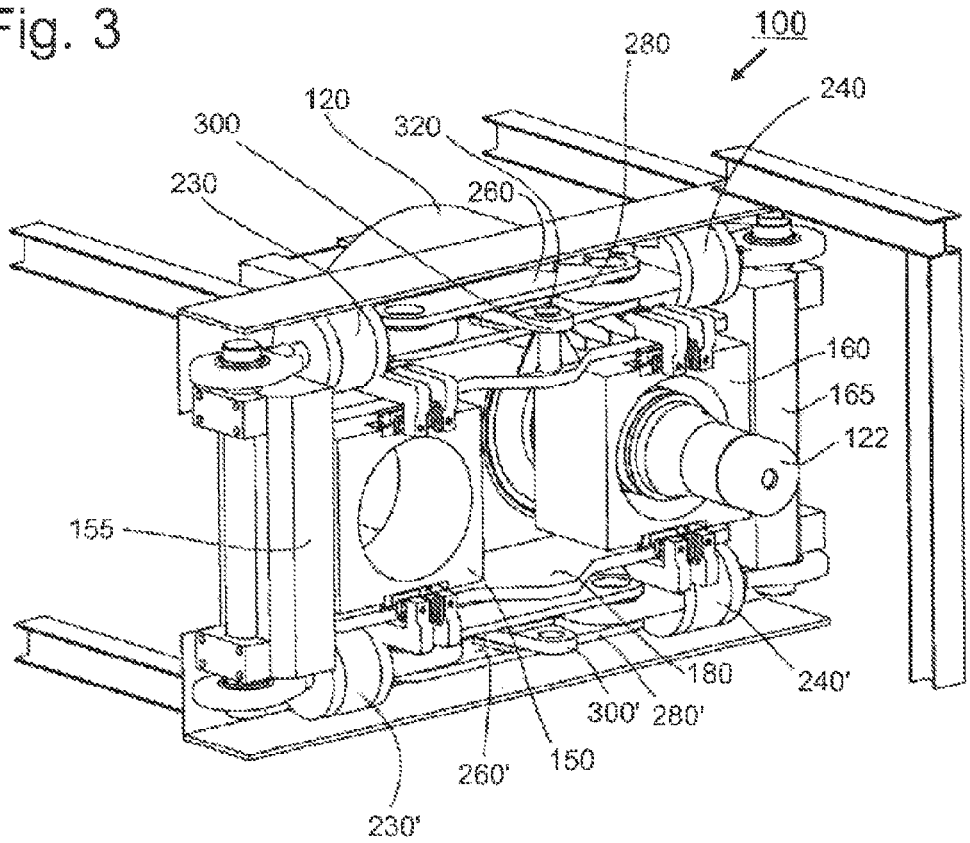
FIG. 3 shows a perspective view of selected elements of an inventive roller press.

Finally, a perspective view of an inventive roller press 100, in which selected elements are blanked out in order to clarify the invention, is represented in FIG. 3. It can be seen from the perspective view that a roll 120 is accommodated via a shaft 122 in a loose bearing housing 160. At this site, the shaft 122 projects from the loose bearing housing 160 and the drive side of the shaft 122 is found there. This loose bearing housing 160 is accommodated, like the loose bearing housing 150 of the second roll 110 (here blanked-out), within a frame made up of several elements, which frame, in this embodiment of the roller press 100, consists of four tensile loaded hydraulic cylinders 230, 230', 240 and 240', the blocks 155 and 165, embracing the loose bearing housings 150 and 160, and the torque balances 260 and 260', wherein this frame forms a closed system of forces which is designed to absorb the force resulting from the pressure in the roll gap 115. Apart from the accommodation in the frame made up of various elements, the here non-blanked-out loose bearing housings 150 and 160 rest on a slide rail 180, which is not part of the above-described frame made up of several elements, but is instead part of a machine frame 171 (not shown here). The slide rail 180 thus absorbs only the weight of the rolls 110 and 120, together with their shafts 111, 112, 121 and 122 and the loose bearing housings 150, 160. The torque balances 260 and 260' consist of two powerful rockers 280, 280', in which the hydraulic cylinders 230, 230', 240 and 240' engage. Between the two rockers 280, 280' is accommodated a pendulum 300, 300', via which the torque balance 260, 260' can rotate about a journal in the form of the pivot 320. This journal is fixedly 15 mounted on a part of the machine frame 171 and absorbs, in comparison to the tensile force of the hydraulic cylinders 230, 230', 240 and 240', lowly dimensioned forces.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

REFERENCE SYMBOL LIST

| | |
|---|---|
| 100 | roller press |
| 110 | roll |
| 111 | shaft |
| 112 | shaft |
| 115 | roll gap |
| 120 | roll |
| 121 | shaft |
| 122 | shaft |
| 130 | fixed bearing housing |
| 140 | fixed bearing housing |
| 150 | loose bearing housing |
| 155 | block |
| 160 | loose bearing housing |
| 165 | block |
| 170 | slide rail |
| 171 | machine frame |
| 180 | slide frame |
| 210 | hydraulic cylinder |
| 210' | hydraulic cylinder |
| 220 | hydraulic cylinder |
| 220' | hydraulic cylinder |
| 230 | hydraulic cylinder |
| 230' | hydraulic cylinder |
| 240 | hydraulic cylinder |
| 240' | hydraulic cylinder |
| 250 | torque balance |
| 250' | torque balance |
| 260 | torque balance |
| 270 | rocker |
| 270' | rocker |
| 280 | rocker |
| 280' | rocker |
| 290 | pendulum |
| 290' | pendulum |
| 300 | pendulum |
| 300' | pendulum |
| 310 | pivot |
| 320 | pivot |

The invention claimed is:

1. A roller press for the pressure treatment or compaction of granular material, comprising:

at least two rolls, configured as movable rolls, which are respectively rotatably mounted in a machine frame via a shaft extending from one side to another side of each of the rolls, are driven in counter rotation and are separated from one another by a roll gap, wherein the shafts of each of the rolls are accommodated in separate bearing housings movably disposed in the machine frame, and wherein on each of the sides of the at least two rolls, two of said bearing housings disposed on a common side of the at least two rolls, and belonging to different ones of the at least two rolls, are connected to each other via at least one pressure cylinder, the connection between the two of said bearing housings including at least one torque balance on each of the sides of the at least two rolls, wherein the at least one torque balance on each of the sides of the at least two rolls is mounted rotatably about a vertical rotation shaft which lies in a plane spanned by the centerline of the roll gap and a vertical line passing through the centerline.

2. The roller press as claimed in claim 1, wherein the at least one torque balance is disposed roughly midway between the bearing housings.

3. The roller press as claimed in claim 1, wherein the at least one torque balance has a rocker, via which the two bearing housings are connected to each other, and has a rotatably mounted pendulum, via which the rocker is mounted pivotably about the rotation shaft.

4. The roller press as claimed in claim 1, wherein the rotation shaft is fixedly connected to the machine frame.

5. The roller press as claimed in claim 1, wherein the pressure cylinders act upon the torque balance respectively in pairs and in mutually opposing arrangement.

6. The roller press as claimed in claim 1, wherein the pressure cylinders are tensile loaded.

7. The roller press as claimed in claim 1, wherein the bearing housings, the pressure cylinders, and the torque balance form a self-contained system of forces.

8. The roller press as claimed in claim 1, wherein at least one of the bearings of at least one roll is a loose bearing, which provides a degree of freedom in the axial direction of the shafts.

9. A method for centering a roll gap of a roller press for the pressure treatment or compaction of granular material, which roller press has at least two rolls, configured as movable rolls, which are each rotatably mounted in a machine frame via a shaft extending from one side to another side of each of the rolls, are driven in counter rotation and are separated from one another by the roll gap, comprising the steps:

accommodating the shafts of each of the rolls in separate bearing housings movably disposed in the machine frame, connecting, on each of the sides of the at least two rolls, two of said bearing housings disposed on a common side of the at least two rolls and belonging to different ones of the at least two rolls to each other via at least one pressure cylinder, and using at least one torque balance between the two of said bearing housings on each of the sides of the at least two rolls, wherein the at least one torque balance on each of the sides of the at least two rolls is mounted rotatably about a vertical rotation shaft which lies in a plane spanned by the centerline of the roll gap and a vertical line passing through the centerline.

* * * * *